US009196390B2

(12) United States Patent
Bloomquist et al.

(10) Patent No.: US 9,196,390 B2
(45) Date of Patent: Nov. 24, 2015

(54) IRRADIATION TARGET ENCAPSULATION ASSEMBLY AND METHOD OF ASSEMBLY

(75) Inventors: Bradley D. Bloomquist, Wilmington, NC (US); Christopher J. Monetta, Wilmington, NC (US); Earl F. Saito, Wilmington, NC (US)

(73) Assignee: GE-HITACHI NUCLEAR ENERGY AMERICAS LLC, Wilmington, NC (US)

( * ) Notice: Subject to any disclaimer, the term of this patent is extended or adjusted under 35 U.S.C. 154(b) by 710 days.

(21) Appl. No.: 13/241,669

(22) Filed: Sep. 23, 2011

(65) Prior Publication Data

US 2013/0077725 A1 Mar. 28, 2013

(51) Int. Cl.

| | |
|---|---|
| ***G21G 1/00*** | (2006.01) |
| ***G21G 1/02*** | (2006.01) |
| *G21C 1/30* | (2006.01) |
| *G21G 1/04* | (2006.01) |

(52) U.S. Cl.
CPC *G21G 1/02* (2013.01); *G21C 1/303* (2013.01); *G21G 1/04* (2013.01)

(58) Field of Classification Search
CPC ..... G21G 1/04; G21G 1/02; G21C 1/303
USPC ..... 376/202
See application file for complete search history.

(56) References Cited

U.S. PATENT DOCUMENTS

| | | | | |
|---|---|---|---|---|
| 3,940,318 | A | 2/1976 | Arino et al. | |
| 4,196,047 | A | 4/1980 | Mitchem et al. | |
| 4,687,621 | A | 8/1987 | Ferrari | |
| 5,633,900 | A * | 5/1997 | Hassal | 376/189 |
| 5,867,546 | A * | 2/1999 | Hassal | 376/202 |
| 6,233,299 | B1 * | 5/2001 | Wakabayashi | 376/202 |
| 6,678,344 | B2 * | 1/2004 | O'Leary et al. | 376/170 |
| 2010/0284503 | A1 * | 11/2010 | Smith et al. | 376/202 |
| 2011/0051874 | A1 * | 3/2011 | Allen et al. | 376/202 |
| 2012/0027152 | A1 * | 2/2012 | Reese et al. | 376/190 |
| 2012/0321027 | A1 * | 12/2012 | Baurichter et al. | 376/194 |

OTHER PUBLICATIONS

Cuttler, Jerry M., "Producing Molybdenum-99 in CANDU Reactors", 31st Annual Conference of the Canadian Nuclear Society, Montréal, Québec, May 24-27, 2010.

* cited by examiner

*Primary Examiner* — Frank J McGue
(74) *Attorney, Agent, or Firm* — Harness, Dickey & Pierce, P.L.C.

(57) ABSTRACT

In one embodiment, an irradiation target encapsulation assembly, includes a container, at least one first irradiation target disposed in the container, at least one second irradiation target disposed in the container, and a positioning structure configured to position the first irradiation target closer to an axial center of the container than the second irradiation target.

19 Claims, 3 Drawing Sheets

IRRADIATION TARGET ENCAPSULATION ASSEMBLY AND METHOD OF ASSEMBLY

BACKGROUND

Example embodiments are directed to an irradiation target encapsulation assembly and/or method for assembling an irradiation target encapsulation assembly.

Radioisotopes have a variety of medical applications stemming from their ability to emit discreet amounts and types of ionizing radiation. This ability makes radioisotopes useful in cancer-related therapy, medical imaging and labeling technology, cancer and other disease diagnosis, medical sterilization, and a variety of other industrial applications.

Radioisotopes, having specific activities are of particular importance in cancer and other medical therapy for their ability to produce a unique and predictable radiation profile. Knowledge of the exact amount of radiation that will be produced by a given radioisotope permits more precise and effective use thereof, such as more timely and effective medical treatments and improved imaging based on the emitted radiation spectrum.

Medical radioisotopes are conventionally produced by bombarding stable parent isotopes in accelerators, cyclotrons or low-power reactors on-site at medical facilities or at production facilities. The produced radioisotopes may be assayed with radiological equipment and separated by relative activity into groups having approximately equal activity in conventional methods.

SUMMARY

In one embodiment, an irradiation target encapsulation assembly, includes a container, at least one first irradiation target disposed in the container, at least one second irradiation target disposed in the container, and a positioning structure configured to position the first irradiation target closer to an axial center of the container than the second irradiation target.

The first irradiation target may be a material including at least one of cobalt (Co), chromium (Cr), copper (Cu), erbium (Er), germanium (Ge), gold (Au), holmium (Ho), iridium (Ir), lutetium (Lu), molybdenum (Mo), palladium (Pd), samarium (Sm), thulium (Tm), ytterbium (Yb), and yttrium (Y).

The second irradiation target may be a material including at least one of cobalt (Co), chromium (Cr), copper (Cu), erbium (Er), germanium (Ge), gold (Au), holmium (Ho), iridium (Ir), lutetium (Lu), molybdenum (Mo), palladium (Pd), samarium (Sm), thulium (Tm), ytterbium (Yb), and yttrium (Y).

In one embodiment, the positioning structure includes a central body extending along the axis of the container, and a spacing structure configured to position the central body along an axis of the container. For example, the spacing structure may include a plurality of projections projecting from the central member. In another embodiment, the spacing structure includes one or more members connected to the central body and having a periphery matching an inner periphery of the container. In these embodiments, the second irradiation target is disposed next to one end of the central body, and the first irradiation target is disposed between the central body and the container. A length of the central body may be based on a desired specific activity resulting from irradiating the second irradiation target. Still further, a cross sectional area of the central body may be based on a desired specific activity resulting from irradiating the first irradiation target.

In another embodiment, the positioning structure has a cross-sectional area that varies along a length thereof to create different sized spaces between the positioning structure and the container for holding multiples of the first irradiation target.

One embodiment of a method for assembling an irradiation target encapsulation assembly, includes placing a position structure within a container and adding a plurality of first irradiation targets to the container. The positioning structure is configured to position the first irradiation targets between the positioning structure and the container. Next, at least one second irradiation target is added to the container. The positioning structure is configured to position the second irradiation target at the end of the position structure. The container is then sealed.

BRIEF DESCRIPTION OF THE DRAWINGS

Example embodiments will become more apparent by describing, in detail, the attached drawings, wherein like elements are represented by like reference numerals, which are given by way of illustration only and thus do not limit the example embodiments herein.

DETAILED DESCRIPTION OF EXAMPLE EMBODIMENTS

Detailed illustrative embodiments of example embodiments are disclosed herein. However, specific structural and functional details disclosed herein are merely representative for purposes of describing example embodiments. The example embodiments may, however, be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the language explicitly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

At least some example embodiments are directed to an irradiation target encapsulation assembly structured to produce both high specific activity and low specific activity irradiation targets when exposed to radiation.

Figure 1:
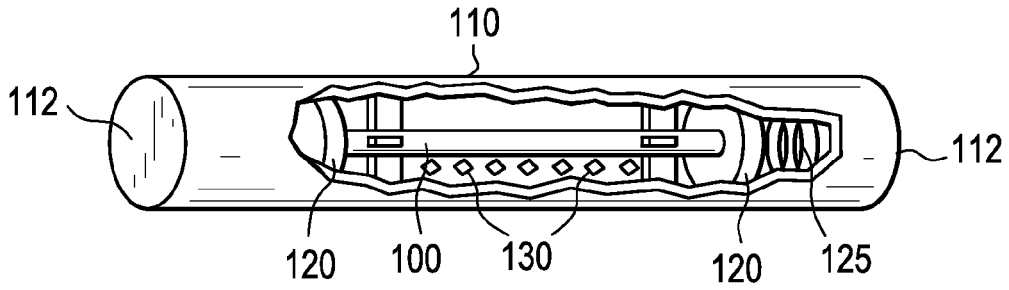
FIG. 1 illustrates an irradiation target encapsulation assembly according to an embodiment.

FIG. 1 illustrates an irradiation target encapsulation assembly according to an embodiment. The encapsulation assembly includes a container 110 having end caps 112 attached at both ends of the container 110 to seal the container 110. For example, the end caps 112 may be attached to the container 110 by any suitable attachment mechanism, i.e., weld, threaded engagement, friction connection, etc. In the embodiment shown in FIG. 1, the container 110 is a hollow, cylindrical tube, but it will be appreciated that the embodiments are not limited to this shape. In one embodiment, the container 110 and caps 112 are made from a material having a low thermal neutron absorption and scattering cross-section, such as zirconium, titanium or aluminum.

Figure 2:
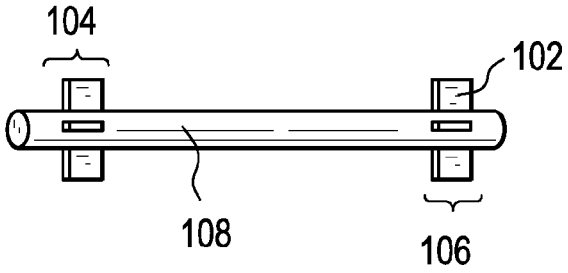
FIG. 2 illustrates an example embodiment of a spacer for the irradiation target encapsulation assembly.

A spacer 100 is disposed within the container 110. FIG. 2 illustrates an embodiment of the spacer 100 in greater detail. As shown, the spacer 100 is a cylindrical rod 108 having fins 102 projecting radially therefrom. In this embodiment, a first set of fins 104 are disposed near one end of the spacer 100, and a second set of fins 106 are disposed near the other end of the spacer 100. Both the first and second sets of fins 104 and 106 include three fins 102 to center the spacer radially within the container. It will be appreciated that the set of fins are not limited to three, the number of sets of fins are not limited to two, and the placement of the fins is not limited to the ends of the spacer 100. In this embodiment, the overall diameter of the spacer and fins substantially matches an inner diameter of the container 110 such that the spacer 100 may slide into the container 110 with the fins 102 positioning the rod 108 along a longitudinal axis of the container 110. In one embodiment, the spacer 100 is made from a material having a low thermal neutron absorption and scattering cross-section, such as zirconium, titanium or aluminum.

As will be appreciated, the rod 108 is not limited to having this shape, but may be a central body having any desired shape or cross-section. Similar, the projecting members positioning the central body within the container are not limited to fins, and will depend on the shape of the central body and the shape of the container 110.

Figure 3:
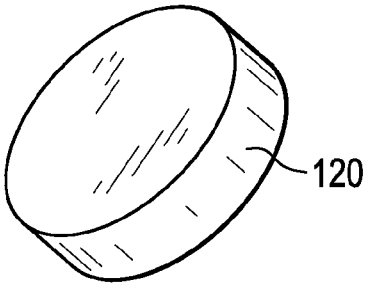
FIG. 3 illustrates a low specific activity irradiation target according to an embodiment.

Returning to FIG. 1, one or more low specific activity (LSA) irradiation targets 120 may be disposed at one or both ends of the spacer 110 within the container 100. FIG. 3 illustrates one example of an LSA irradiation target 120. As shown, the LSA irradiation target 120 may have the shape of a disk. However, the LSA irradiation target 120 is not limited to this shape. For example, the LSA irradiation target 120 may be a cylinder, a cube, etc. In one embodiment, the LSA irradiation targets 120 have a cross-section or periphery matching that of the interior of the container 110 such that the LSA irradiation targets 120 assist in maintaining the HSA targets 130 between the spacer 100 and the container 110. Still further, in at least one embodiment, the LSA targets 120 are sized such that the spacer 100 maintains the LSA targets 120 at ends thereof.

During irradiation, the LSA irradiation targets 120 disposed at the ends of the container 110 will experience a lower radiation level than the high specific activity targets 130 discussed below. As used herein "radiation level" or "radiation field" includes any type of ionizing radiation exposure capable of transmuting targets placed in the radiation field, including, for example, high-energy ions from a particle accelerator or a flux of neutrons of various energies in a commercial nuclear reactor.

As further shown in FIG. 1, a bias spring 126 may bias the LSA irradiation targets 120 against the spacer 100. For ease of illustration only one end of the container 110 is shown having a bias spring 126. However, it will be appreciated that one or both ends of the container may include bias springs. Alternatively, sufficient LSA irradiation targets 120 may be disposed at an end of the container 110 to fill the space between the end of the spacer 100 and the end of the container 110.

Still further, FIG. 1 illustrates that high specific activity (HSA) irradiation targets 130 are disposed within the space of the container 110 defined by the spacer 100 and the container 110. The size of the HSA irradiation targets 130 may be adjusted as appropriate for their intended use (e.g., radiography targets, brachytherapy seeds, elution matrix, etc.). HSA irradiation target may also be spherical-, rectangular, and/or cylindrical, or any other size and shape that permits filling the space defined by the spacer 100 and the container 110. For instance, the HSA irradiation target 130 may by cylindrical having an outside diameter of 1 mm and a height of about 1 mm. As alluded to above, the HSA irradiation targets 130 are disposed within an area of the container 110 that will experience a higher radiation level than the LSA targets disposed towards the ends of the container 110.

Suitable targets for the LSA and HSA targets may be formed of cobalt (Co), chromium (Cr), copper (Cu), erbium (Er), germanium (Ge), gold (Au), holmium (Ho), iridium (Ir), lutetium (Lu), molybdenum (Mo), palladium (Pd), samarium (Sm), thulium (Tm), ytterbium (Yb), and/or yttrium (Y), although other suitable materials may also be used. In one embodiment, the LSA and HSA targets are not nuclear fuel. In one embodiment the LSA and HSA targets are formed of the same material. In another embodiment, the LSA and HSA targets are formed of different materials. As will be appreciated, the differentiation between LSA and HAS differs for different isotopes. For example, for Co-60, LSA is roughly <200 Ci/g, and HSA is roughly >200 Ci/g.

The irradiation target encapsulation assembly discussed above includes a spacer that serves as a positioning structure to position HSA targets toward the axial or longitudinal center of the container 100 and positions the LSA targets towards the axial or longitudinal periphery of the container 100. The container 100 may be placed in any radial orientation and/or axial orientation within a test reactor or a nuclear reactor. In one embodiment, the container 100 may have marking or indicia indicating one or more of desired orientation of the container, the identity of the container, the identity of targets within the container, etc.

The spacer 110 may be sized to thinly spread the HSA targets radially within the container. Accordingly, the diameter of the spacer rod 108 may be selected to achieve a desired thickness of the HSA targets; and thus achieve a desired level of activity. As will be appreciated, in a more general sense, regardless of the shape of the central body 108, the cross-section thereof may be selected to achieve a desired thickness of the HSA targets. The spacer rod 108 may be solid or hollow. In one embodiment, the spacer rod 108 may be made from or include a neutron moderation material (e.g., graphite) and/or a neutron multiplying material (e.g., beryllium). A length of the spacer 110 is selected to position the LSA targets at the desired axial position within the container to achieve the desired level of activity. Accordingly, the length of spacer may depend on the reactor flux profile. The spacer 110 may include different sets of fins 102 with the sets rotationally offset from one another or symmetrically aligned.

Figure 4:
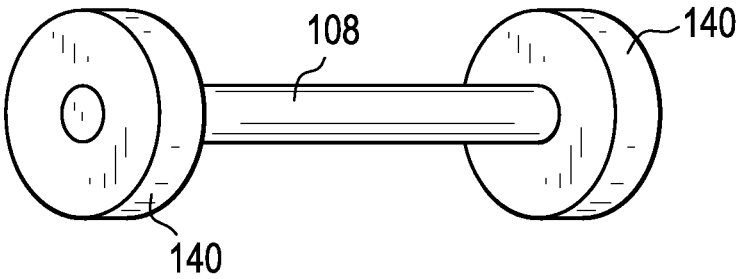
FIG. 4 illustrates another example embodiment of a spacer for the irradiation target encapsulation assembly.

FIG. 4 illustrates another embodiment of the spacer 100. As shown, the spacer 100 includes a spacer rod 108 as described with respect to FIG. 2. Further, the spacer includes end caps 140 attached at each end of the spacer rod 108. The end caps may be attached to the spacer rod using any suitable attachment mechanism, i.e., weld, threaded engagement, friction connection, etc. In the embodiment of FIG. 4, the end caps 140 are illustrated as disks with threaded engagement to the spacer rod 108. The size of the end caps 140 may be selected to create a desired level of separation between the LSA and HSA targets to produce desired levels of activity for those targets and/or to contain HSA targets. As will be appreciated, additional disks could be disposed along the length of the spacer rod 108 to support the spacer rod 108, and/or compartmentalize HSA targets 130. As will be appreciated, regardless of the shape of the central body 108 or the container 110, the caps 140 may be dimensioned such that a periphery thereof matches an inner periphery of the container.

Figure 5:
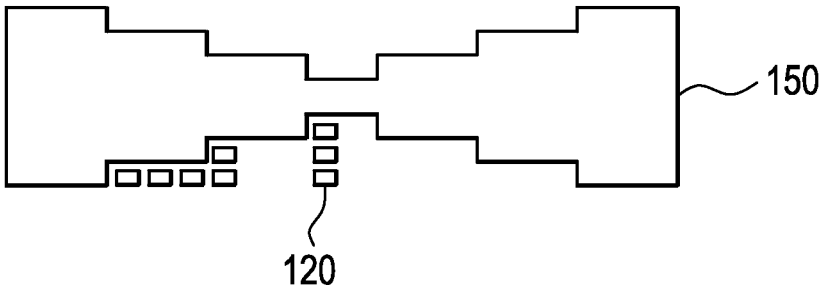
FIG. 5 illustrates another example embodiment of a spacer for the irradiation target encapsulation assembly.

FIG. 5 illustrates another embodiment of the spacer 100. As shown, the spacer 100 includes a rod 150, the diameter of which varies along the length of the rod 150. The different diameters create different thicknesses for layers of HSA targets. As such, this changes the axial fluence profile, and creates different desired activities for the HSA targets. It will also be appreciated that the changes depend on the reactor flux profile of the reactor in which the container 110 is placed. As will be appreciated, the spacer 100 is not limited to being a rod, but may have any shape. Accordingly, the spacer body may have a cross-sectional area that varies (e.g., stepwise, continuous, etc.) such that different thicknesses for the layer of HSA targets are created. Namely, different sized spaces between the spacer 100 and the container 110 are created.

As a still further alternative, the spacer 100 may be eliminated and the HSA targets may be randomly packed within the container between the LSA targets and/or dividing structures, which divide the HSA targets from the LSA targets.

The above-described features of example embodiment encapsulation assembly and the known radiation profile to which the encapsulation assembly is to be exposed may uniquely enable accurate irradiation of irradiation targets 120 and 130 use therein. For example, knowing an irradiation flux type and profile; a shape, size, and absorption cross-section of irradiation targets 120 and 130; and size, shape, position, and absorption cross-section of the example embodiment encapsulation assembly, and loading positions of the example embodiment encapsulation assembly, one may very accurately position and irradiate targets 120 and 130 to produce desired isotopes and/or radioisotopes of desired activity. Similarly, one skilled in the art can vary any of these parameters, including irradiation target type, shape, size, position, absorption cross-section etc., in example embodiments in order to produce desired isotopes and/or radioisotopes of desired activity. Still further the addition of moderating elements may be used to achieve the desired activity. As mentioned above, moderating material may be used in the spacer rod 108. However, the example embodiments are not limited to using moderating material in this manner. For example, the container 100 may include a liner or partial liner on the inner diameter of the container made of moderating material.

Next an embodiment of a method for assembling an irradiation target encapsulation assembly will be described with respect to FIG. 6. As shown in step S600 an end cap 112 is attached to the container 110. Then the first LSA target or targets are inserted in step S610. In one embodiment, prior to inserting the first LSA target(s), a biasing spring may be inserted prior to inserting the LSA target(s). The spacer 100 is then inserted into the container 110 in step S620. The HSA targets are added to the container in step S630 followed by the second LSA target or targets in step S640. A second end cap 112 is then attached to the container 110 in step S650. In one embodiment, a biasing spring may be added prior to attaching the second end cap 112.

Figure 6:
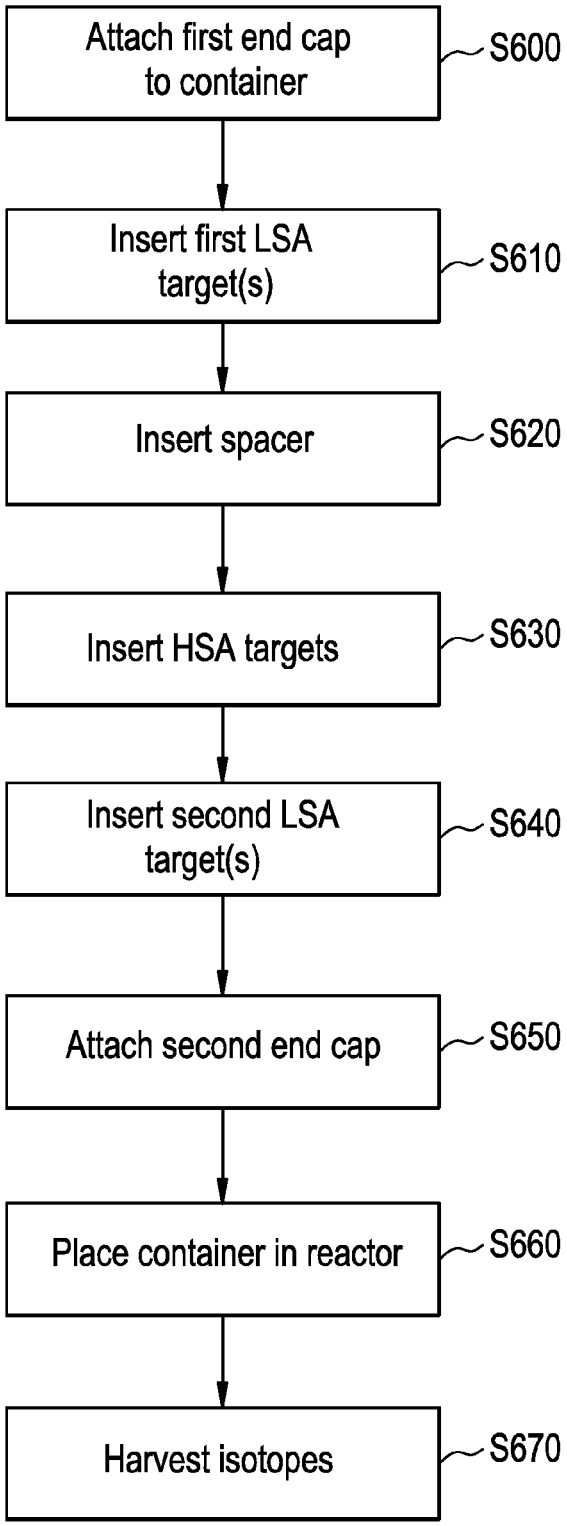
FIG. 6 illustrates a flow chart of a method for assembling an irradiation target encapsulation assembly according to an example embodiment.

As shown in FIG. 6, the irradiation target encapsulation assembly may then be placed within a nuclear reactor in step S660 at a desired position, in a desired orientation and for a desired duration. The position, orientation and duration may be design parameters chosen using well-known Monte Carlo N-Particle (MCNP) modeling to produced desired levels of activity in the LSA and HSA targets. Afterwards, the targets may be harvested in step S670 by removing the targets from the reactor and from the container 110.

As will be appreciated one of method steps S610 and S640 may be eliminated such that LSA target(s) appear at only one end of the spacer 100.

Example embodiments and methods thus being described, it will be appreciated by one skilled in the art that example embodiments may be varied through routine experimentation and without further inventive activity. For example, aspects of the different embodiment may be combined. Similarly, for example, although cylindrical example embodiments are shown, other device types, shapes, and configurations may be used in example embodiments and methods. Variations are not to be regarded as departure from the spirit and scope of the exemplary embodiments, and all such modifications as would be obvious to one skilled in the art are intended to be included within the scope of the following claims.

We claim:

1. An irradiation target encapsulation assembly, comprising:

a container defining a cavity;

at least one first irradiation target disposed in the cavity of the container;

at least one second irradiation target disposed in the cavity of the container;

a positioning structure disposed in the cavity of the container and configured to position the first irradiation target closer to an axial center of the cavity of the container than the second irradiation target; and wherein the container is sealed, wherein the positioning structure comprises:

a central body extending along an axis of the container; and a spacing structure configured to position the central body along the axis of the container.

2. The assembly of claim 1, wherein the first and second irradiation targets do not include nuclear fuel.

3. The assembly of claim 1, wherein the first irradiation target is a material including at least one of cobalt (Co), chromium (Cr), copper (Cu), erbium (Er), germanium (Ge), gold (Au), holmium (Ho), iridium (Ir), lutetium (Lu), molybdenum (Mo), palladium (Pd), samarium (Sm), thulium (Tm), ytterbium (Yb), and yttrium (Y); and the second irradiation target is a material including at least one of cobalt (Co), chromium (Cr), copper (Cu), erbium (Er), germanium (Ge), gold (Au), holmium (Ho), iridium (Ir), lutetium (Lu), molybdenum (Mo), palladium (Pd), samarium (Sm), thulium (Tm), ytterbium (Yb), and yttrium (Y).

4. The assembly of claim 1, wherein the first and second irradiation targets are a same material.

5. The assembly of claim 1, wherein the first and second irradiation targets are different materials.

6. The assembly of claim 1, wherein the spacing structure includes a plurality of projections projecting from the central body.

7. The assembly of claim 1, wherein the spacing structure includes one or more members connected to the central body and having a periphery matching an inner periphery of the container.

8. The assembly of claim 1, wherein the container has a cylindrical shape; and the central body has a rod shape.

9. The assembly of claim 1, wherein the second irradiation target is disposed at next to one end of the central body; and the first irradiation target is disposed between the central body and the container.

10. The assembly of claim 9, wherein a length of the central body is based on the reactor flux profile and a desired specific activity resulting from irradiating the first and second irradiation targets in the flux profile.

11. The assembly of claim 9, wherein a cross sectional area of the central body is based on a desired specific activity resulting from irradiating the first irradiation target.

12. The assembly of claim 1, wherein the central body includes a neutron moderator and/or a neutron multiplier.

13. The assembly of claim 1, wherein the positioning structure has a cross-sectional area that varies along a length thereof to create different sized spaces between the positioning structure and the container for holding the first irradiation target(s).

14. The assembly of claim 1, wherein the container is a hollow cylinder;

the positioning structure includes a rod having fins projecting from the rod;

the second irradiation target is disposed at one end of the rod; and a plurality of first irradiation targets are disposed between the rod and the container.

15. The assembly of claim 1, wherein the container is a hollow cylinder;

the positioning structure includes a rod having one or more annular disk attached thereto;

the second irradiation target is disposed at one end of the rod; and a plurality of first irradiation targets are disposed between the rod and the container.

16. The assembly of claim 1, wherein the container is a hollow cylinder;

the positioning structure includes a cylindrical member, at least two portions of the cylindrical member have different diameters;

the second irradiation target is disposed at one end of the cylindrical member; and a plurality of first irradiation targets are disposed between the cylindrical member and the container.

17. The assembly of claim 1, wherein the container includes a liner, and the liner includes a neutron moderator and/or neutron multiplier.

18. An irradiation target encapsulation assembly, comprising:

a container defining a cavity;

a first irradiation target disposed in the cavity of the container;

a second irradiation target disposed in the cavity of the container;

a positioning structure disposed in the cavity of the container and configured to position the second irradiation target closer to an axial periphery of the cavity of the container than the first irradiation target; and wherein the container is sealed, wherein the positioning structure includes, a central body extending along an axis of the container; and a spacing structure configured to position the central body along the axis of the container.

19. A method for assembling an irradiation target encapsulation assembly, comprising:

placing a positioning structure within a container defining a cavity;

adding a plurality of first irradiation targets to the cavity of the container, the positioning structure configured to position the first irradiation targets between the positioning structure and the container;

adding at least one second irradiation target to the cavity of the container, the positioning structure configured to position the second irradiation target at an end of the position structure; and sealing the container, wherein the positioning structure comprises:

a central body extending along an axis of the container; and a spacing structure configured to position the central body along the axis of the container.

* * * * *